US007677915B2

(12) United States Patent
Bessede et al.

(10) Patent No.: US 7,677,915 B2
(45) Date of Patent: Mar. 16, 2010

(54) ELECTRICAL CONTACT ELEMENT FOR MEDIUM OR HIGH VOLTAGE ELECTRICAL EQUIPMENT, AND CORRESPONDING, METHOD AND EQUIPMENT

(75) Inventors: Jean-Luc Bessede, Chateauvillain (FR); Pierre Giannini, Meyzieu (FR); Oana Visata, Saint Egreve (FR)

(73) Assignee: Areva T&D SA, Parlis la Defense (FR)

( * ) Notice: Subject to any disclaimer, the term of this patent is extended or adjusted under 35 U.S.C. 154(b) by 663 days.

(21) Appl. No.: 10/583,728

(22) PCT Filed: Dec. 28, 2004

(86) PCT No.: PCT/FR2004/003398

§ 371 (c)(1),
(2), (4) Date: Jun. 20, 2006

(87) PCT Pub. No.: WO2005/069327

PCT Pub. Date: Jul. 28, 2005

(65) Prior Publication Data

US 2007/0111590 A1 May 17, 2007

(30) Foreign Application Priority Data

Dec. 29, 2003 (FR) ..... 03 51218

(51) Int. Cl.
*H01R 13/58* (2006.01)

(52) U.S. Cl. ..... 439/459

(58) Field of Classification Search ..... 439/459, 439/357, 352
See application file for complete search history.

(56) References Cited

U.S. PATENT DOCUMENTS

| | | | | |
|---|---|---|---|---|
| 1,732,839 | A | 10/1929 | Hardy | |
| 3,561,444 | A * | 2/1971 | Boucher | 128/200.16 |
| 6,059,577 | A | 5/2000 | Eriksson | |
| 2002/0096662 | A1 | 7/2002 | Schleicher et al. | |

FOREIGN PATENT DOCUMENTS

| | | |
|---|---|---|
| DE | 42 30 060 | 3/1994 |
| EP | 0 649 994 | 4/1995 |
| EP | 0 890 758 | 1/1999 |
| FR | 1 292 079 | 3/1962 |
| FR | 2 204 864 | 5/1974 |
| FR | 2 811 147 | 1/2002 |

* cited by examiner

*Primary Examiner*—Jean F Duverne
(74) *Attorney, Agent, or Firm*—Oblon, Spivak, McClelland, Maier & Neustadt, L.L.P.

(57) ABSTRACT

An electrical contact member, suitable for electrically interconnecting two conductive members in series, which members can move relative to each other and are part of an electrical apparatus. The electrical contact includes a strength-imparting base layer made of an electrically conductive material, and a coating layer formed from metallic silver and configured to come into contact with the two electrically conductive members. The coating layer has a micro-structure formed by pure silver crystals, with a presence of nodules made of silver and of an additional metallic material formed by at least one additional metal that is different from silver.

27 Claims, 3 Drawing Sheets

ELECTRICAL CONTACT ELEMENT FOR MEDIUM OR HIGH VOLTAGE ELECTRICAL EQUIPMENT, AND CORRESPONDING, METHOD AND EQUIPMENT

The present invention relates to an electrical contact member for medium-voltage or high-voltage electrical apparatus, to a method of manufacturing such a member, and to medium-voltage or high-voltage electrical apparatus provided with such a member.

The term "medium-voltage or high-voltage" is used to designate a voltage greater than about 1000 volts.

The invention is applicable to two main types of electrical apparatus.

Firstly, the invention is applicable to apparatus of the moving type, namely, in particular, interrupter electrical apparatus. In particular, such apparatus can be constituted by circuit-breakers, disconnectors, contactors, or indeed load switches.

In known manner, such apparatus of the moving type comprises a contact assembly which is provided with a fixed member and with a moving member. The moving member can thus be moved relative to the fixed member between a contact position and a separated or interrupting position.

Each member is provided firstly with a respective arcing contact element. In addition, said fixed and moving members are provided with permanent contacts which provide electrical continuity, in particular in the closed position. Said permanent contacts, which are of the fixed type or of the moving type, constitute electrical contact members in the meaning of the invention.

A connection piece is also provided that generally passes through the casing of the apparatus so as to be connected to an outside electricity line. In service, it is necessary to maintain electrical contact between said connection piece and the above-mentioned moving member, regardless of the position of said moving member. Such electrical continuity is provided by an electrical contact member to which the invention also applies.

The invention is also applicable to electrical apparatus of the generally stationary type. In particular, such apparatus can be constituted by a set of busbars.

In such apparatus, the electrical continuity between two adjacent bars, which are generally stationary relative to each other, is provided by a coupling piece that surrounds the facing ends of said busbars. In service, in particular under the effect of operating clearance, expansion, or indeed vibration, the two busbars are subjected to slight relative displacement, so that it is difficult to fix the above-mentioned coupling piece to them.

An electrical contact member is thus used, to which the invention also applies. This electrical contact member is interposed between facing walls of the coupling piece and of a corresponding busbar.

To sum up, the present invention relates to an electrical contact member which is suitable for electrically interconnecting in series two conductive members that are part of medium-voltage or high-voltage electrical apparatus. The two members in question can move relative to each other, either because of the very nature of the electrical apparatus, or because of operating contingencies of said apparatus.

Various known types of electrical contact member are described below.

FR-A-0 334 094 discloses a rolling contact member of the resilient type. The dimensions of that hollow member, which is deformable, are such that it is compressed slightly between the two moving members that it interconnects electrically.

That makes it possible to exert a mechanical pressure guaranteeing the desired electrical contact.

Unfortunately, that known solution suffers from certain drawbacks, in particular inherent to the nature of the material used. In particular, that material, which is phosphor bronze, is not adapted to use at high voltage.

U.S. Pat. No. 6,059,577 discloses an electrical contact member in the form of a finger which is made of a material having both low resistivity and good resistance to corrosion. In particular, that material is an alloy of copper, of chromium and of zirconium, or else an alloy of copper and of beryllium. Unfortunately, those materials are not adapted, in satisfactory manner, to an use of the dynamic type, in particular since they tend to wear considerably.

US-A 2002/096662 discloses an electrical contact member organized in the form of a metal tape which is made of copper or of an alloy covered with tin and silver, the silver being in a proportion of no more than 4% by weight. Unfortunately, that material does not lend itself well to dynamic-type use.

DE-A-4 230 060 discloses an arcing contact element for a circuit-breaker. The coating of that arcing contact element is made of an alloy of silver and of palladium. Unfortunately, such a solution is unsatisfactory, in particular insofar as palladium suffers from certain drawbacks in terms of electrical conductivity.

Finally, FR-A-2 811 147 discloses an electrical contact member which is constituted by a strip of springs. Said springs, which are brought out of the plane of the strip by torsion, are coated with a layer of an electrically conductive material, such as silver.

An object of the invention is to remedy all of the above-mentioned drawbacks of the prior art.

A particular object of the invention is to provide an electrical contact that lends itself in satisfactory manner to being adapted to medium voltage or high voltage.

Another object of the invention is to provide such a contact member that provides electrical continuity between two moving members whose relative speed can be quite high. Merely by way of non-limiting example, mention can be made of relative speeds lying in the range 1 meter per second (m/s) to 50 m/s.

Another object of the invention is to provide such a member that withstands high temperatures well, and that offers satisfactory electrical and mechanical properties, while inducing only a small contact force on the moving members that it interconnects electrically.

Another object of the invention is to provide such a contact member that has high chemical resistance, in particular high resistance to corrosion. In certain uses of such a contact member, it operates in an aggressive environment, due to the presence of corrosive substances resulting from decomposition of certain dielectric gases that are initially present in the apparatus.

Finally, an object of the invention is to provide such a contact member that is of relatively low cost.

To these ends, the invention provides an electrical contact member suitable for electrically interconnecting two conductive members in series, which members can move relative to each other, and are part of medium-voltage or high-voltage electrical apparatus, in particular interrupter apparatus or a set of busbars, at least a portion of said contact member comprising a strength-imparting base layer made of an electrically conductive material, and a coating layer formed from metallic silver and designed to come into contact with the two electrically conductive members, said coating layer being present over at least a portion of the outer surface of the base layer, said electrical contact member being characterized in that said coating layer has a micro-structure formed by pure silver crystals, with the presence of nodules made of silver and of an additional metallic material formed by at least one additional metal that is different from silver.

The base layer imparts good electrical and mechanical properties to the contact member of the invention. In the meaning of the invention, the electrically conductive material of said base layer has electrical resistivity of less than 200 micro-ohm centimeters (μΩ·cm).

The nature of the coating layer also imparts to it good properties in terms of electrical conduction. In addition, the additional material that is associated with the silver imparts to said silver improved mechanical properties in particular in terms of hardening.

The above-mentioned characteristics are more particularly illustrated with reference to accompanying FIG. 1 which is a microscopic diagram showing the micro-structure of the coating layer that is part of an electrical contact member of the invention.

This micro-structure is obtained either by a metallurgical-type method or by an electrolytic-type method.

However, it should be noted that, when an electrolytic method is used, the characteristic size of the structure is smaller because it is about one hundred nanometers. In contrast, when a metallurgical method is used, the characteristic size of said structure is higher, because it is about ten micrometers (μm).

As can be seen in FIG. 1, a large majority of the coating layer is constituted by metallic silver, with an additional metal referenced M being present in a very small proportion, e.g. 0.5%. Various silver crystals are thus present, each of which is referenced I, the silver crystals being mutually separated by grain boundaries II. The presence of nodules III of a complex compound (referenced AgM in this example) should also be noted.

Thus, in particular by means of the presence of the complex nodules, the additional material guarantees that the mechanical properties of the coating layer are improved, in particular by means of the known phenomenon of structural hardening. In addition, when said layer is obtained by an electrolytic method, said additional material enables the atoms of the successive layers of silver to be arranged better, thereby making said additional material more compact and thus of higher hardness. The above-mentioned phenomena thus make it possible to prevent the coating layer from wearing quickly due to the contact member rubbing against the two electrically conductive members.

FIG. 2 shows a metallurgical structure of a prior art coating layer, made of metallic silver only. Thus, only silver crystals I are present, without any additional element. Although that structure is satisfactory in terms of electrical conductivity, it is not of good quality in terms of strength.

Furthermore, by means of the nature of the components of said additional material, and given that said material is present in a very small quantity in the coating layer, the electrical conductivity of said coating layer is not reduced prohibitively. This characteristic of the invention is shown more precisely with reference to accompanying FIG. 3 which shows the micro-structure of a coating layer that is not in accordance with the invention, and in which a large fraction of additional material is present.

FIG. 3 thus shows a change in the overall nature of said coating layer because the various pure silver crystals I have been replaced with crystals IV of a complex compound, which is AgM in this example. Although it is satisfactory in terms of strength, such a coating layer is not at all suitable as regards its electrical conductivity.

Finally, the various materials used for making the contact member of the invention guarantee that said contact member is of relatively low cost.

According to a characteristic of the invention, the or each metal forming the additional material does not belong to the platinum column of the periodic table of elements. By way of explanation, it is recalled that the platinum column of the periodic table of elements contains the following elements, namely nickel, palladium, and platinum.

According to an advantageous characteristic of the invention, the additional material is formed by at least one element chosen from copper, phosphorus and indium.

According to an advantageous characteristic of the invention, the additional material is present in the coating layer in a proportion of less than 1% by weight, preferably less than 0.5% by weight, and even more preferably less than 0.1% by weight. This makes it possible for the electrical conductivity of the coating layer not to be reduced significantly.

According to another advantageous characteristic of the invention, the additional material is present in the coating layer in a proportion of more than 0.001% by weight, and preferably more than 0.01% by weight. This imparts good mechanical properties to the coating layer, in particular in terms of abrasion when it is subjected to intensive dynamic use.

It should be noted that the coating layer may be present over the entire outer surface of the base layer. Alternatively, it may be provided only over those zones which come into contact with the conductive members that are to be electrically interconnected by the contact member in the meaning of the invention.

According to another advantageous characteristic of the invention, the thickness of the coating layer lies in the range 1 μm to 1000 μm, and preferably in the range 10 μm to 500 μm. It should be noted that the value of said thickness depends in particular on the size of the electrical contact member, and on the use that is to be made thereof.

According to another advantageous characteristic of the invention, the base layer is made of copper, alloyed with zirconium and/or with chromium.

In an advantageous measure, the chromium and/or the zirconium are present in a proportion or in proportions of less than 1% by weight of the base layer, and preferably less than 0.5% by weight. This imparts good mechanical and thermal properties to said base layer, without however significantly degrading its electrical properties.

It should be noted that other elements may optionally be associated with said copper alloy with a view to forming the base layer. For example, such elements may be phosphorous, lead, or indeed tin, or any other element whose conductivity is higher than 5 mega-siemens per meter (MS/m), that can be present in a proportion of less than 0.5% by weight.

According to an advantageous-characteristic of the invention, between the base layer and the coating layer, an interface layer is provided that serves to improve the adhesion between said base layer and said coating layer. Said interface layer mechanically supports the coating layer while also preventing the various component elements of the base layer and of the coating layer from diffusing from either one of said layers to the other.

For example, such an interface layer may be made of optionally alloyed nickel, or of optionally alloyed palladium. The interface layer advantageously has a thickness lying in the range 1 μm to 10 μm.

According to another characteristic of the invention, the electrical contact member is looped back on itself in the manner of a ring.

According to an additional characteristic, the electrical contact member is formed in one piece. It may, in particular, be formed of a single rolled-up wire forming a succession of turns. Manufacturing such a wire is described in particular in EP-A-0 890 758.

It should be noted that the wire may be of section that is of any shape, namely, in particular, circular, polygonal with rounded edges, elliptical, or indeed oval.

By way of an alternative, the electrical contact member may be formed of a plurality of contact elements.

In a first embodiment, the various contact elements are secured together. In particular, they may be strips folded up concertina-like and whose facing ends are secured together, so that the various strips form a ring. The elements may also be punched-out strips, or cutout and die-punched strips, as in the teaching of FR-A-2 811 147.

In another embodiment of the invention, the various contact elements are independent. The elements may then be finger-shaped elements that are provided discretely at respective ones of the inner and outer peripheries of the two electrically conductive members.

The invention also provides a method of manufacturing an electrical contact member as defined above, comprising the following steps:

at least the base layer is shaped; and at least a portion of the outer surface of the base layer is covered with a coating layer.

In a first variant, only the base layer is shaped, and then said base layer as shaped is covered with the coating layer.

In another variant of the invention, firstly the base layer is covered with the coating layer, then both the base layer and the coating layer are shaped together.

For this purpose, it is possible to use co-lamination technology which is known per se.

In an additional variant of the invention, the base layer is shaped while it is being covered with the coating layer. Such shaping is performed conventionally, e.g. by making use of a known wire-drawing method.

In a first implementation of the invention, firstly the coating layer is formed in the form of an alloy of silver and of the additional material, and then the base layer is covered with said coating layer as formed. In other words, the coating layer is pre-alloyed before it is applied to the base layer.

By way of an alternative, the base layer is covered with substantially pure silver, then the resulting layer of substantially pure silver is covered with the additional material. In which case, the additional material progressively diffuses through the silver layer in a manner known per se, e.g. under the effect of temperature, so as to form the coating layer.

It should also be noted that, in a first variant implementation, the optional interface layer may be disposed on the base layer after said base layer has been shaped. By way of an alternative, it is possible firstly to cover the base layer with the interface layer, and then to shape both of the layers simultaneously.

The invention also provides medium-voltage or high-voltage electrical apparatus comprising at least two electrically conductive members that can move relative to each other in service, and at least one electrical contact member suitable for electrically interconnecting two adjacent conductive members, said apparatus being characterized in that each electrical contact member is a as defined above.

According to a first characteristic of the invention, the electrical apparatus is an interrupter electrical apparatus, in particular a circuit-breaker or a disconnector.

According to another characteristic of the invention, the electrical apparatus is a set of busbars.

In a first variant of the invention, the two electrically conductive members are disposed concentrically and the or each electrical contact member is held stationary, in service, by being wedged between the facing walls of the two conductive members. In particular, said electrical contact member may be received in a groove provided in one or the other of the two electrically conductive members.

In a second variant, the two electrically conductive members are disposed one behind the other, a hollow coupling piece fitting over the facing ends of said two conductive members, while the or each electrical contact is held stationary, in service, by wedging between the facing walls of said coupling piece and of at least one of said two conductive members.

The invention is described below with reference to the accompanying drawings, which are given by way of non-limiting examples, and in which, in addition to above-mentioned FIGS. 1 to 3:

Figure 2:
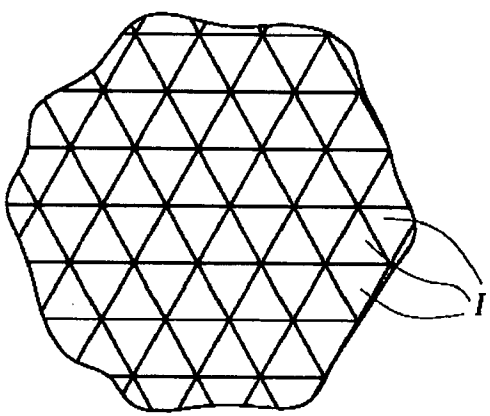
Figure 1:
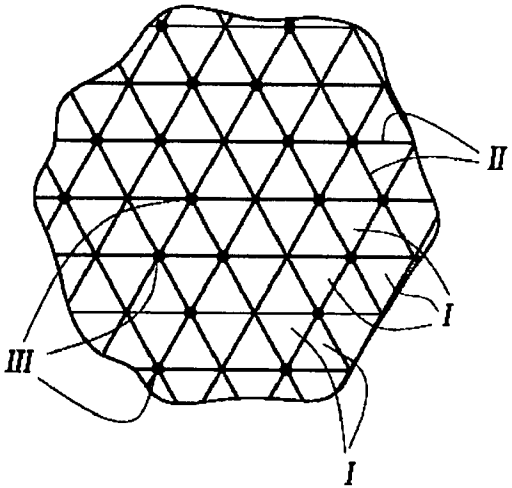
Figure 3:
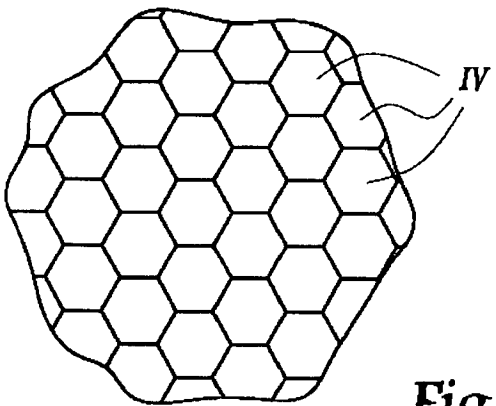
Figure 4:
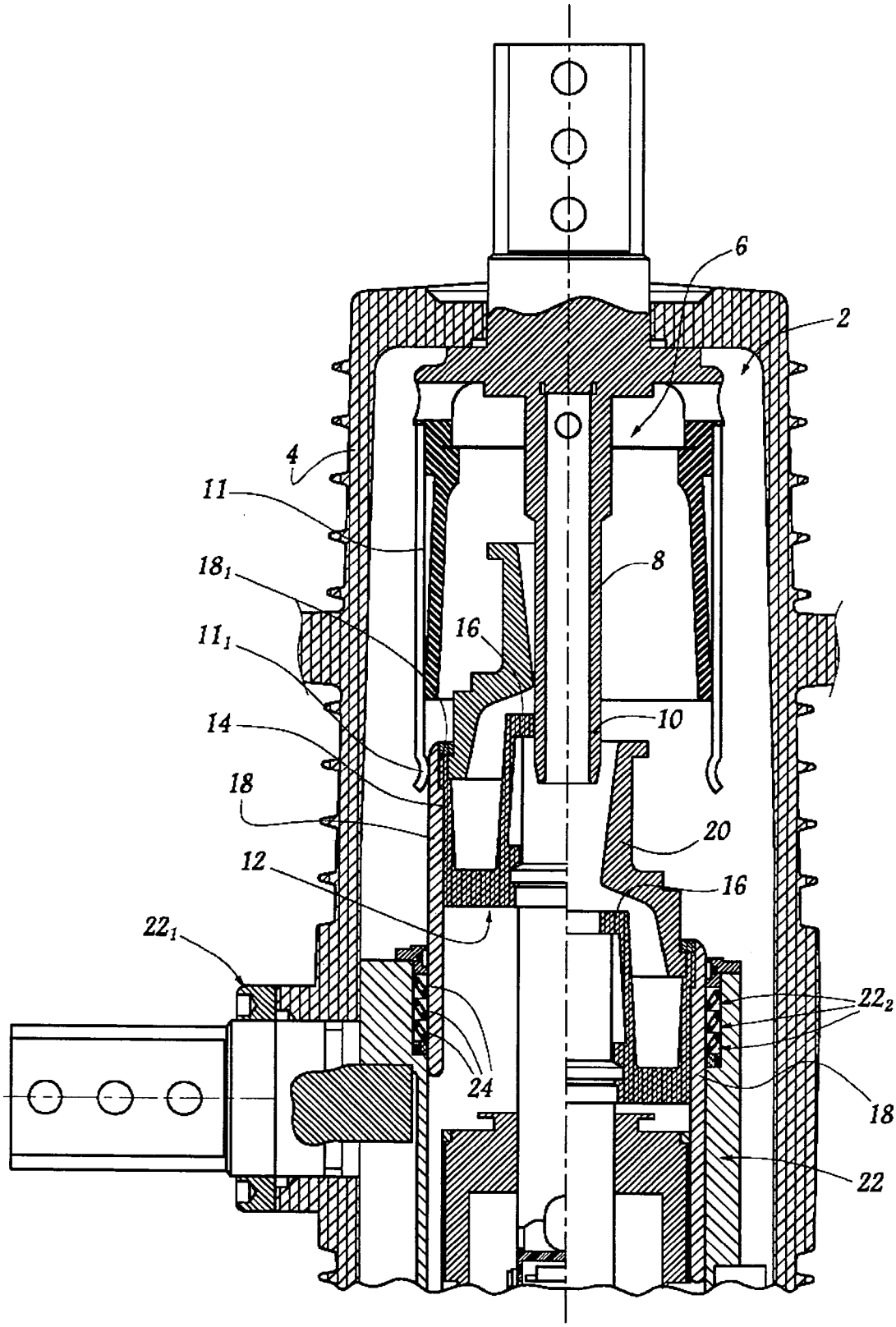
FIG. 4 is a fragmentary longitudinal section view of electrical apparatus of the invention.

FIG. 4 is a fragmentary view of a first type of electrical apparatus to which the invention applies and which, in this example, is medium-voltage or high-voltage interrupting apparatus, e.g. a circuit-breaker. In FIG. 4, only the interrupting chamber of the circuit-breaker is shown. The configuration of the interrupting chamber is conventional and it is therefore described only briefly below.

The chamber 2, which is defined by an insulating cylindrical casing 4, is filled with an insulating gas such as, for example, sulfur hexafluoride ($SF_6$). Firstly, it contains a fixed contact member given overall reference 6.

In known manner, the member 6 includes a support 8 on which an arcing contact element 10 is mounted. The fixed member 6 is further provided with a fixed permanent contact given reference 11, and that is of conventional type.

The interrupting chamber 2 also encloses a moving contact member given overall reference 12. Said moving contact member includes a support 14 on which a moving arcing contact 16 is mounted. The moving member 12 is conventionally provided with a contact tube 18 that forms a moving permanent contact which supports an insulating nozzle 20.

In service, and in a manner known per se, the moving member 12 can be moved between a contact position shown on the left of FIG. 4 and in which the elements 10 and 16 and the contacts 11 and 18 are in mutual contact, and an interrupting position shown on the right of FIG. 4 and in which the two elements 10 and 16 and the contacts 11 and 18 are mutually separated.

During such use, the contact tube 18 moves in the vicinity of the inside walls of a connection piece 22 defining an annular channel for receiving the contact tube 18. Said connection piece 22 is extended by a transverse extension $\mathbf{22}_1$ passing through the casing 4 in leaktight manner. It is also connected, in conventional manner, to an electricity line (not shown).

The walls of the connection piece 22 are provided with a plurality of (three, in this example) annular grooves $\mathbf{22}_2$. Each of the grooves receives a respective electrical contact member of the invention, each electrical contact member being designated by overall reference 24. Thus, in service, the three contact members 24 provide electrical continuity between the contact tube 18 of the moving member 12 and the connection piece 22.

By way of a variant, it should be noted that the contact members 24 can be received in grooves which, instead of being provided in the walls of the piece 22, are provided in the walls of the moving contact tube 18.

In FIG. 4, the various contact members 24 are shown very diagrammatically. One of the members 24 is shown more precisely in FIG. 5.

Figure 5:
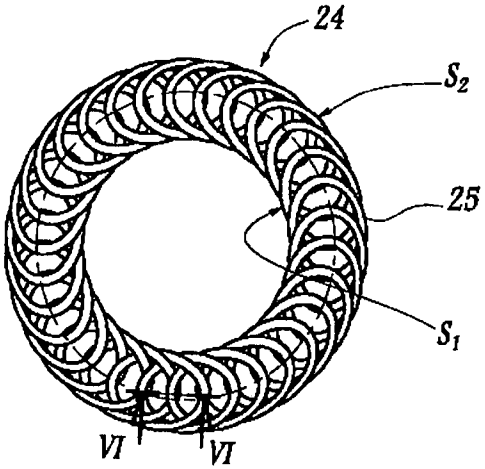
FIG. 5 is a front view of an electrical contact member that equips the apparatus of FIG. 4.

As shown in FIG. 5, the member 24 is formed by a single metal wire 25 which is looped back on itself so as to form a succession of turns. The configuration of the wire 25 is as described, for example, in EP-A-0 890 758, the contents of that document being incorporated for reference into the present description.

In service, the annular member 24 has two or more physical, and therefore electrical, contact surfaces. The first surface is an inner surface $S_1$ via which the member 24 comes into contact with the tube 18. In addition, the outer surface $S_2$ of said member 24 enables it to come into contact with the walls of the connection piece 22.

Figure 6:
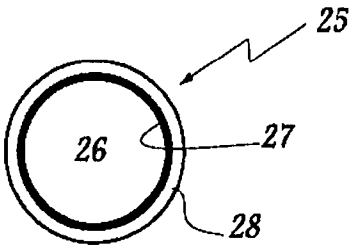
FIG. 6 is a section view on line VI-VI of FIG. 5.

FIG. 6 is a cross-section view showing the various component layers of the wire 25 forming the contact member 24.

Firstly a base layer 26 is provided that is made of an alloy of copper and of zirconium. For example, said base layer has a diameter in the vicinity of 5 millimeters (mm).

The base layer 26 receives an interface layer 27 made of nickel and whose thickness is 20 μm, for example. The interface layer 27 makes it possible to improve adhesion between the base layer 26 and a coating layer 28 which extends over the entire outer periphery of the base layer 26.

The coating layer 28, which is made of silver alloyed with indium, the proportion of indium being 0.09% by weight, has a thickness of 100 μm. By way of a variant, it should be noted that the coating layer 28 can be provided only at an inner contact surface $S_1$ and at an outer contact surface $S_2$, which surfaces are shown in FIG. 5.

Figure 7:
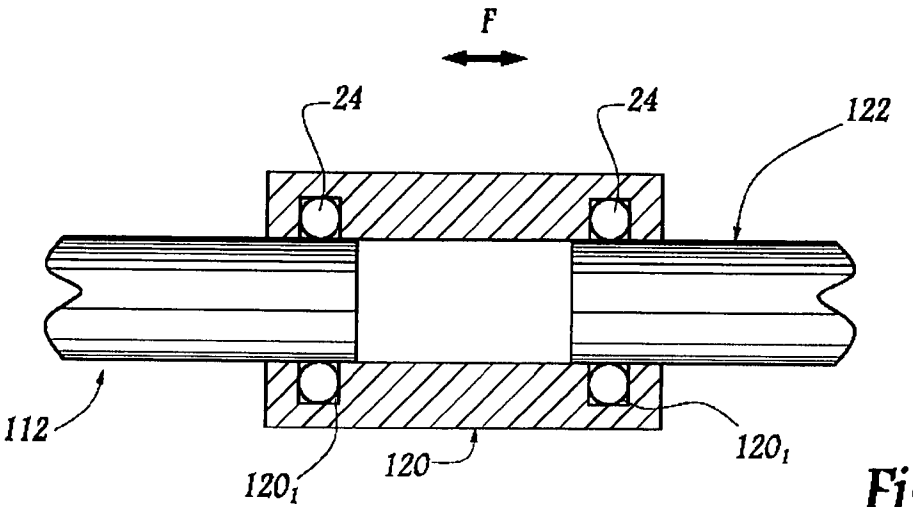
FIG. 7 is a diagrammatic view of a variant embodiment of electrical apparatus of the invention.

FIG. 7 shows a second type of electrical apparatus to which the invention applies. In this example, it is a set of busbars of a type known per se.

FIG. 7 shows only two busbars 112 and 122 of known structure. A tubular coupling piece 120 is also provided that fits over the facing ends of the two busbars 112 and 132. At its two ends, the coupling piece 120 is provided with respective grooves $\mathbf{120}_1$, each of which receives a respective electrical contact member 24 which is as described with reference to FIGS. 4 to 6.

In service, under the effect of the operating stresses to which the busbars 112 and 122 are subjected, in particular vibration, clearance, or expansion, the two bars are subjected to mutual displacement, as indicated by the double-headed arrow F. The presence of the coupling piece 120, associated with the members 24, accommodates such displacement, while continuing to provide electrical continuity between the two busbars 112 and 122.

In a variant, it is possible for only one end of the coupling piece 120 to be provided with one or more electrical contact members 24. In which case, the other end of the coupling piece is fixed directly to the corresponding busbar, in particular by screw-fastening.

By way of an additional variant, it is possible to make provision for one and/or the other of the permanent contacts 11 and 18 to be coated at least partially with a coating layer of the invention. In which case, such a layer is provided in particular at the respective contact surfaces that are referenced $\mathbf{11}_1$ and $\mathbf{18}_1$ in FIG. 4 and that are part of the permanent contacts 11 and 18.

The invention claimed is:

1. An electrical contact member suitable for electrically interconnecting two conductive members the two conductive members movable relative to each other, and are part of medium-voltage or high-voltage electrical apparatus, the contact member comprising:

a strength-imparting base layer made of an electrically conductive material; and a coating layer formed from metallic silver and configured to come into contact with the two conductive members, the coating layer being present over at least a portion of an outer surface of the base layer, wherein the coating layer has a micro-structure formed by pure silver crystals, with a presence of nodules made of silver and of an additional metallic material formed by at least one additional metal that is different from silver, the additional material being present in the coating layer in a proportion of less than 1% by weight, or less than 0.5% by weight, and or less than 0.1% by weight.

2. An electrical contact member according to claim 1, wherein the additional material is present in the coating layer in a proportion of more than 0.001% by weight, or more than 0.01% by weight.

3. An electrical contact member according to claim 1, wherein each metal forming the additional material does not belong to the platinum column of the periodic table of elements.

4. An electrical contact member according to claim 3, wherein the additional material is formed by at least one element chosen from copper, phosphorus, and indium.

5. An electrical contact member according to claim 1, wherein a thickness of the coating layer lies in a range 1 μm to 1000 μm, or in a range 10 μm to 500 μm.

6. An electrical contact member according to claim 1, wherein the base layer is made of copper, alloyed with zirconium and/or with chromium.

7. An electrical contact member according to claim 6, wherein at least one of the chromium and the zirconium are present in a proportion or in proportions of less than 1% by weight of the base layer, or less than 0.5% by weight.

8. An electrical contact member according to claim 1, further comprising:

an interface layer located between the base layer and the coating layer configured to improve adhesion between the base layer and the coating layer.

9. An electrical contact member according to claim 8, wherein the interface layer is made of alloyed nickel, or of alloyed palladium.

10. An electrical contact member according to claim 1, wherein the electrical contact member is looped back on itself in a manner of a ring.

11. An electrical contact member according to claim 1, wherein the electrical contact member is formed in one piece.

12. An electrical contact member according claim 11, wherein the electrical contact member is formed of a single rolled-up wire forming a succession of turns.

13. An electrical contact member according to claim 1, wherein the electrical contact member is formed of a plurality of contact elements.

14. An electrical contact member according to claim 13, wherein the various contact elements are secured together.

15. An electrical contact member according to claim 13, wherein the plurality of contact elements are independent.

16. A method of manufacturing an electrical contact member according to claim 1, comprising:

shaping at least the base layer; and covering at least a portion of the outer surface of the base layer with a coating layer.

17. A method according to claim 16, wherein only the base layer is shaped, and then the base layer as shaped is covered with the coating layer.

18. A method according to claim 16, wherein firstly the base layer is covered with the coating layer, then both the base layer and the coating layer are shaped together.

19. A method according to claim 16, wherein the base layer is shaped while being covered with the coating layer.

20. A method according to claim 16, wherein firstly the coating layer is formed in a form of an alloy of silver and of the additional material, and then the base layer is covered with the coating layer as formed.

21. A method according to claim 16, wherein the base layer is covered with substantially pure silver, and then the resulting layer of substantially pure silver is covered with the additional material.

22. A medium-voltage or high-voltage electrical apparatus comprising:

at least two electrically conductive members are arranged adjacent to each other that are movable relative to each other; and at least one electrical contact suitable for electrically interconnecting the at least two electrically conductive members, wherein the at least one electrical contact member is a contact member according to claim 1.

23. An apparatus according to claim 22, wherein the apparatus is an interrupter electrical apparatus, a circuit-breaker, or a disconnector.

24. An apparatus according to claim 22, wherein the apparatus is a set of busbars.

25. An apparatus according to claim 22, wherein the two electrically conductive members are disposed concentrically and each electrical contact member is held stationary, in service, by being wedged between facing walls of the two conductive members.

26. An apparatus according to claim 25, wherein the electrical contact member is received in a groove provided in one or the other of the two electrically conductive members.

27. An apparatus according to claim 22, wherein the two electrically conductive members are disposed one behind the other, a hollow coupling piece fitting over facing ends of the two conductive members, while each electrical contact is held stationary, in service, by wedging between facing walls of the coupling piece and of at least one of the two conductive members.

* * * * *

UNITED STATES PATENT AND TRADEMARK OFFICE

CERTIFICATE OF CORRECTION

PATENT NO. : 7,677,915 B2
APPLICATION NO. : 10/583728
DATED : March 16, 2010
INVENTOR(S) : Bessede et al.

It is certified that error appears in the above-identified patent and that said Letters Patent is hereby corrected as shown below:

On the title page, Item (73), the Assignee's informations is incorrect. Item (73) should read:

-- (73) Assignee: Areva T&D SA, Paris la Defense (FR) --

Signed and Sealed this

Eleventh Day of May, 2010

David J. Kappos

David J. Kappos
*Director of the United States Patent and Trademark Office*